US008547003B2

(12) United States Patent
Wu

(10) Patent No.: US 8,547,003 B2
(45) Date of Patent: Oct. 1, 2013

(54) HEAT-DISSIPATING MODULE AND LED LAMP HAVING THE SAME

(75) Inventor: Wei Chung Wu, Taoyuan (TW)

(73) Assignee: Fin-Core Corporation (TW)

( * ) Notice: Subject to any disclaimer, the term of this patent is extended or adjusted under 35 U.S.C. 154(b) by 235 days.

(21) Appl. No.: 13/068,404

(22) Filed: May 9, 2011

(65) Prior Publication Data

US 2012/0194055 A1 Aug. 2, 2012

(30) Foreign Application Priority Data

Jan. 28, 2011 (TW) ..... 100201976 U

(51) Int. Cl.

| | |
|---|---|
| ***H01J 1/02*** | (2006.01) |
| ***H01J 7/24*** | (2006.01) |
| ***H01J 61/52*** | (2006.01) |
| ***H01K 1/58*** | (2006.01) |

(52) U.S. Cl.

USPC ..... 313/46; 313/45; 165/185; 362/218; 362/294; 362/612

(58) Field of Classification Search

USPC ..... 313/45–46; 365/218, 294, 373, 365/612, 555, 545, 249.02, 311.02, 800; 165/185; 362/218, 294, 373, 612, 555, 545, 362/249.02, 311.02, 800

See application file for complete search history.

(56) References Cited

U.S. PATENT DOCUMENTS

| | | | | |
|---|---|---|---|---|
| 7,670,028 | B2 * | 3/2010 | Liu et al. | 362/294 |
| 7,753,106 | B2 * | 7/2010 | Lin et al. | 165/80.3 |
| 7,993,025 | B2 * | 8/2011 | Chiu | 362/249.02 |
| 8,087,456 | B2 * | 1/2012 | Wei | 165/185 |
| 8,258,681 | B2 * | 9/2012 | Lee et al. | 313/45 |
| 8,322,892 | B2 * | 12/2012 | Scordino et al. | 362/294 |
| D674,928 | S * | 1/2013 | Maxik et al. | D26/2 |
| 8,348,471 | B2 * | 1/2013 | Huang et al. | 362/294 |
| 2007/0084595 | A1 * | 4/2007 | Lin et al. | 165/185 |
| 2009/0009999 | A1 * | 1/2009 | Wang et al. | 362/249 |
| 2009/0141500 | A1 * | 6/2009 | Peng | 362/294 |
| 2010/0110691 | A1 * | 5/2010 | Hsu et al. | 362/294 |
| 2010/0186937 | A1 * | 7/2010 | Liang | 165/185 |
| 2011/0116267 | A1 * | 5/2011 | Huang | 362/249.02 |
| 2012/0257389 | A1 * | 10/2012 | Lai | 362/249.02 |
| 2012/0273180 | A1 * | 11/2012 | Tseng et al. | 165/185 |

* cited by examiner

*Primary Examiner* — Anne Hines
*Assistant Examiner* — Jose M Diaz

(57) ABSTRACT

A heat-dissipating module includes a plurality of cooling fins arranged radially, spaced apart from each other, and connected annularly in a manner that a hollow core is formed centrally in the heat-dissipating module. The cooling fins each bend at a preset position thereof and in a first direction, such that the cooling fins each include a first flap and a second flap. The first flap and the second flap together form a preset included angle therebetween.

8 Claims, 8 Drawing Sheets

A-A section

HEAT-DISSIPATING MODULE AND LED LAMP HAVING THE SAME

BACKGROUND OF THE INVENTION

1. Field of the Invention

The present invention relates to heat-dissipating modules for use with LED lamps, and more particularly, to a heat-dissipating module having cooling fins bent at a preset angle for increasing the heat-dissipating area of the heat-dissipating module greatly and thereby enhancing the heat-dissipating efficiency of the heat-dissipating module.

2. Description of the Prior Art

Among a wide variety of commercially available lamps, incandescent lamps always account for a constantly large market share. Conventional incandescent lamps are power-consuming, highly heat-generating, and relatively short-lived. Not only do conventional incandescent lamps become environment-unfriendly in the present era of high-priced electricity supply, but the highly heat-generating conventional incandescent lamps are likely to end up with an accident, such as a fire caused by a short circuit. In view of this, innovative novel products were launched into the lighting equipment market in recent years. For example, projector lamps which use an LED as a major light source substitute for conventional incandescent lamps.

In general, conventional LED lamps are likely to generate high heat and thus are usually equipped with a plurality of cooling fins for dissipating the generated high heat. Referring to FIG. 1, there is shown a schematic cross-sectional view of a conventional LED lamp 1. As shown in the drawing, the conventional LED lamp 1 comprises an LED unit 11, a heat-dissipating module 12, a central post 13, a control circuit 14, and a base 15. The LED unit 11 is disposed at one end of the heat-dissipating module 12. The heat-dissipating module 12 comprises a plurality of cooling fins 121 which enclose the central post 13. The other end of the heat-dissipating module 12 is coupled to the base 15. The control circuit 14 is disposed at the hollow core of the central post 13 and electrically connected to the LED unit 11 and the base 15.

Although the conventional LED lamp 1 is more power-saving and environment-friendly than conventional incandescent lamps, the LED unit 11 is also confronted with a problem with heat dissipation. This is particularly true of the LED unit 11 that generates plenty of heat while operating, and thus the LED unit 11 has to dissipate heat quickly through the heat-dissipating module 12. Furthermore, when operating at high temperature or operating for a long period of time, the control circuit 14 is likely to be compromised by the aging of components, such as electrolytic capacitors and integrated circuits (IC), which eventually causes damage to the components of the control circuit 14; as a result, the LED lamp 1 disadvantageously features a great increase in its failure rate and non-conforming rate and even a reduction in its service life.

In view of this, the heat generated by the LED unit 11 in operation is dissipated to its environs solely by the heat-dissipating module 12 comprising the cooling fins 121 which are made of metal and known by persons skilled in the art. Accordingly, it is imperative to circumvent the limitation of dimensional specifications, such as standardized outer diameter, of commercially available indoor lamps, so as to maximize the heat-dissipating surface area of the heat-dissipating module 12 of the commercially available indoor lamps while still meeting the requirement of the standardized outer diameter, enhance the heat-dissipating efficiency of the heat-dissipating module 12, speed up the temperature dropping process of the LED lamp 1, extend the service life of the LED lamp 1, and protect the control circuit 14 against an accelerated aging process which might otherwise occur at high temperature.

SUMMARY OF INVENTION

Accordingly, it is a primary objective of the present invention to provide a heat-dissipating module of an LED lamp, wherein not only does the heat-dissipating module have cooling fins bent at a preset position thereof and in a first direction such that the cooling fins each bend at a preset included angle, but an elongate curved bend is disposed at a preset peripheral position of the plate-shaped cooling fin, to thereby reinforce the cooling fins and increase the heat-dissipating area of the cooling fins while still meeting the requirement of a uniform outer diameter.

Another objective of the present invention is to provide a heat-dissipating module of an LED lamp, wherein heat generated by an LED of the LED lamp is insulated from a circuit board by means of a thermally insulating panel, so as to extend the service life of the circuit board.

Yet another objective of the present invention is to provide a heat-dissipating module of an LED lamp, wherein a heat conduction medium for increasing a heat transfer rate is applied to engaging surfaces of a substrate, and the engaging surfaces of the substrate enable the substrate to engage with a first connecting portion and a second connecting portion.

In order to achieve the aforementioned objective, the present invention discloses an LED lamp having a heat-dissipating module. The LED lamp comprises:

a substrate with at least an LED unit thereon;

a heat-dissipating module comprising a plurality of cooling fins arranged radially, spaced apart from each other, and connected annularly in a manner that the substrate is coupled to the heat-dissipating module and a hollow core is formed centrally in the heat-dissipating module;

a base provided in form of a hollow casing and coupled to the heat-dissipating module from beneath; and a circuit board comprising a circuit loop, wherein the circuit board is received in the base and electrically connected to the at least an LED unit coupled to the substrate through the hollow core;

wherein the cooling fins each bend at a preset position thereof and in a first direction, such that the cooling fins each further comprise a first flap and a second flap, wherein the first flap and the second flap have a preset included angle therebetween.

In a preferred embodiment, the included angle of the cooling fins ranges between 100° and 170°.

In a preferred embodiment, a first connecting portion and a second connecting portion, which bend in the first direction, are disposed at preset positions on upper edges of the first flap and the second flap of the cooling fins, respectively, wherein a step-like extending portion and a carrying portion bending in the first direction are disposed on the upper edges of the first flap, an outward-facing hook is disposed at a top end of the extending portion, wherein a first lower step is formed above the heat-dissipating module and defined by the extending portion relative to the first connecting portion and the second connecting portion, wherein a second lower step with an inward profile is disposed at the lower edge of each of the cooling fins and oriented in a direction opposite to the first lower step, wherein a third connecting portion and a fourth connecting portion corresponding in position to the first connecting portion and the second connecting portion, respectively, are disposed on an inner side of the second lower step and bent inward.

In a preferred embodiment, the LED lamp further comprises a thermally insulating panel inserted into the base and positioned between the heat-dissipating module and the circuit board, wherein the thermally insulating panel has a via and is spaced apart from the heat-dissipating module by a preset distance ranging between 2 mm and 6 mm.

In a preferred embodiment, the LED lamp further comprises a fixing element, an annular protective cover, and a lampshade; and wherein:

the base is coupled to an engaging portion beneath the heat-dissipating module;

the fixing element is disposed above a third connecting portion and a fourth connecting portion, positioned inside the second lower step, and centrally provided with an opening in communication with the hollow core, the substrate being disposed above the first lower step;

the annular protective cover is engaged with the hook of the extending portion, coupled to the carrying portion, and configured to encase and enclose a periphery of the cooling fins;

the lampshade is coupled to the annular protective cover and adapted to cover the substrate from above; and a peripheral margin of the cooling fins doubles back from a preset position thereof and extends toward the first lower step to form an elongate curved bend.

In a preferred embodiment, the LED lamp is further characterized in that:

the substrate is soldered to the first connecting portion and the second connecting portion through engaging surfaces of the substrate and by means of a solder paste;

the fixing element is affixed to the third connecting portion and the fourth connecting portion through engaging surfaces of the fixing element and by means of a heat-resistant glue;

the curved bend has a pleat 2 mm to 6 mm wide substantially, and a pleated portion of the curved bend is not attached to a surface of the first flap;

the substrate is one of a ceramic substrate, a FR4 substrate, and a metal substrate; and the fixing element is made of one of a bakelite sheet, metal, and plastic.

BRIEF DESCRIPTION OF THE DRAWINGS

The present invention will now be specified with reference to its preferred embodiment illustrated in the drawings, in which.

DESCRIPTION OF THE PREFERRED EMBODIMENT

Figure 1:
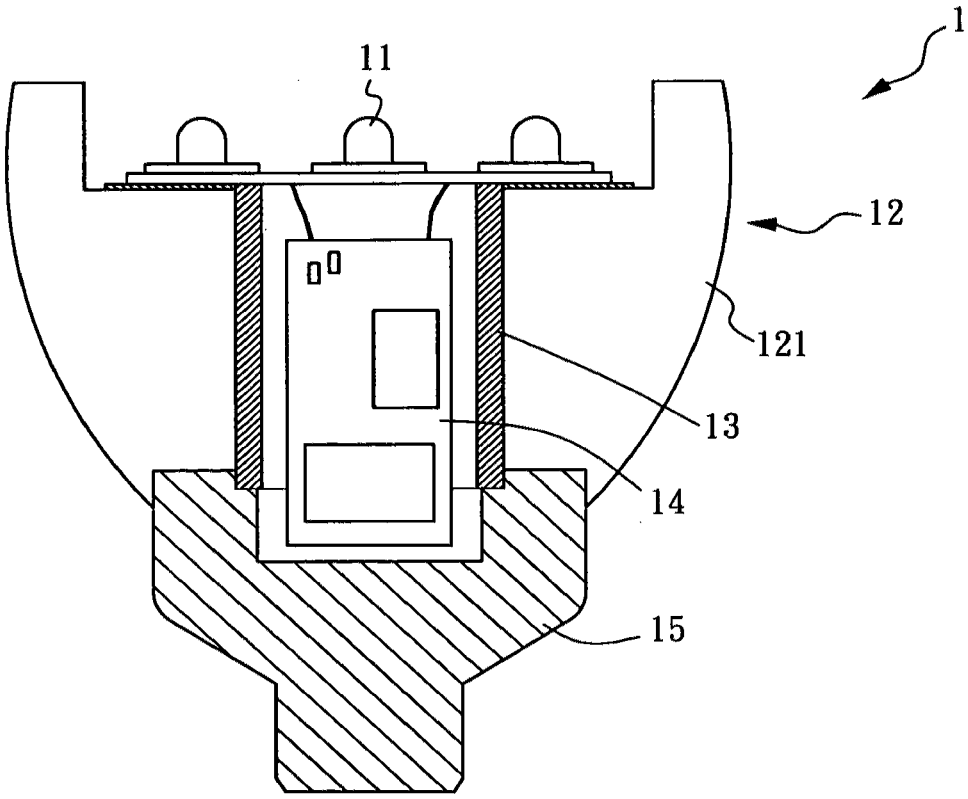
FIG. 1 (PRIOR ART)
FIG. 1 is a schematic cross-sectional view of a conventional LED lamp.
Figure 2:
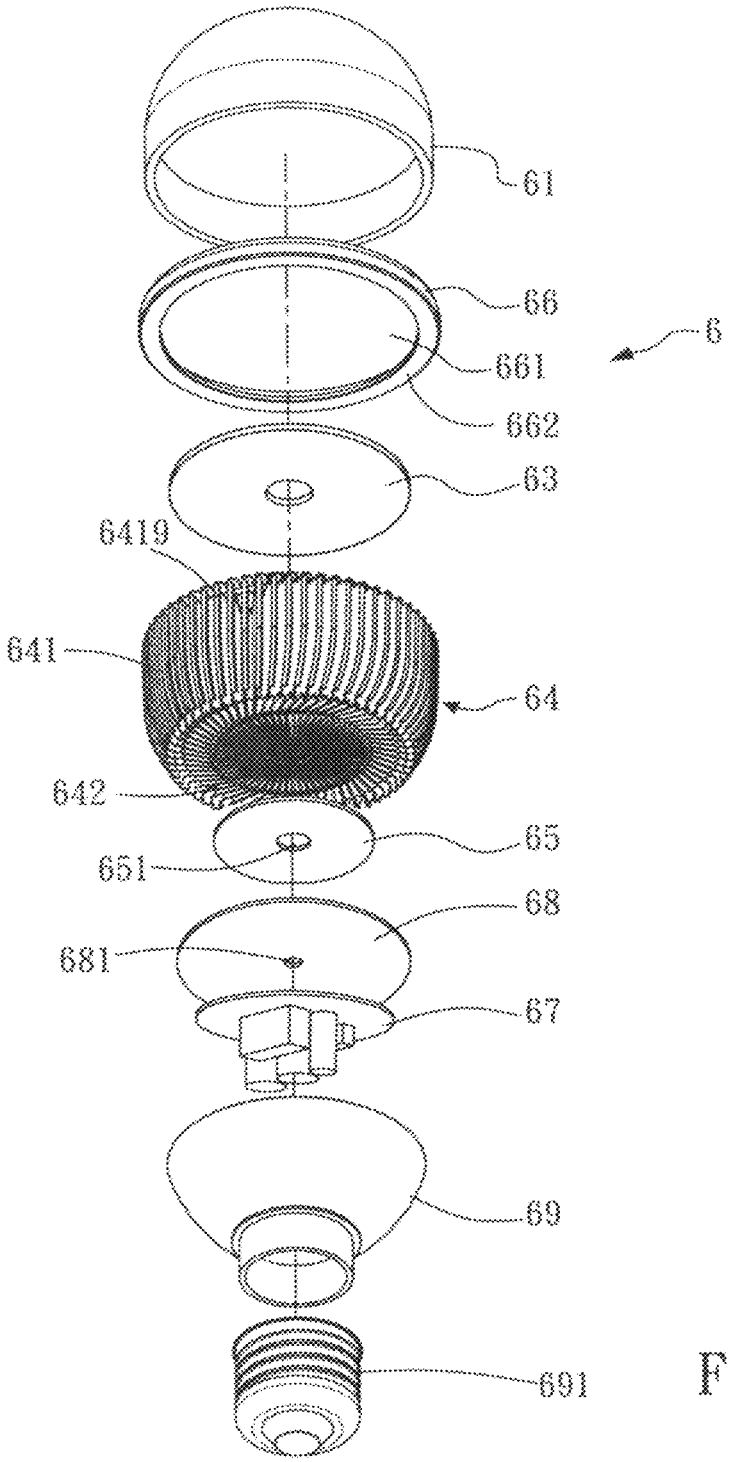
FIG. 2 is an exploded view of an LED lamp having a heat-dissipating module according to the present invention.
Figure 3:
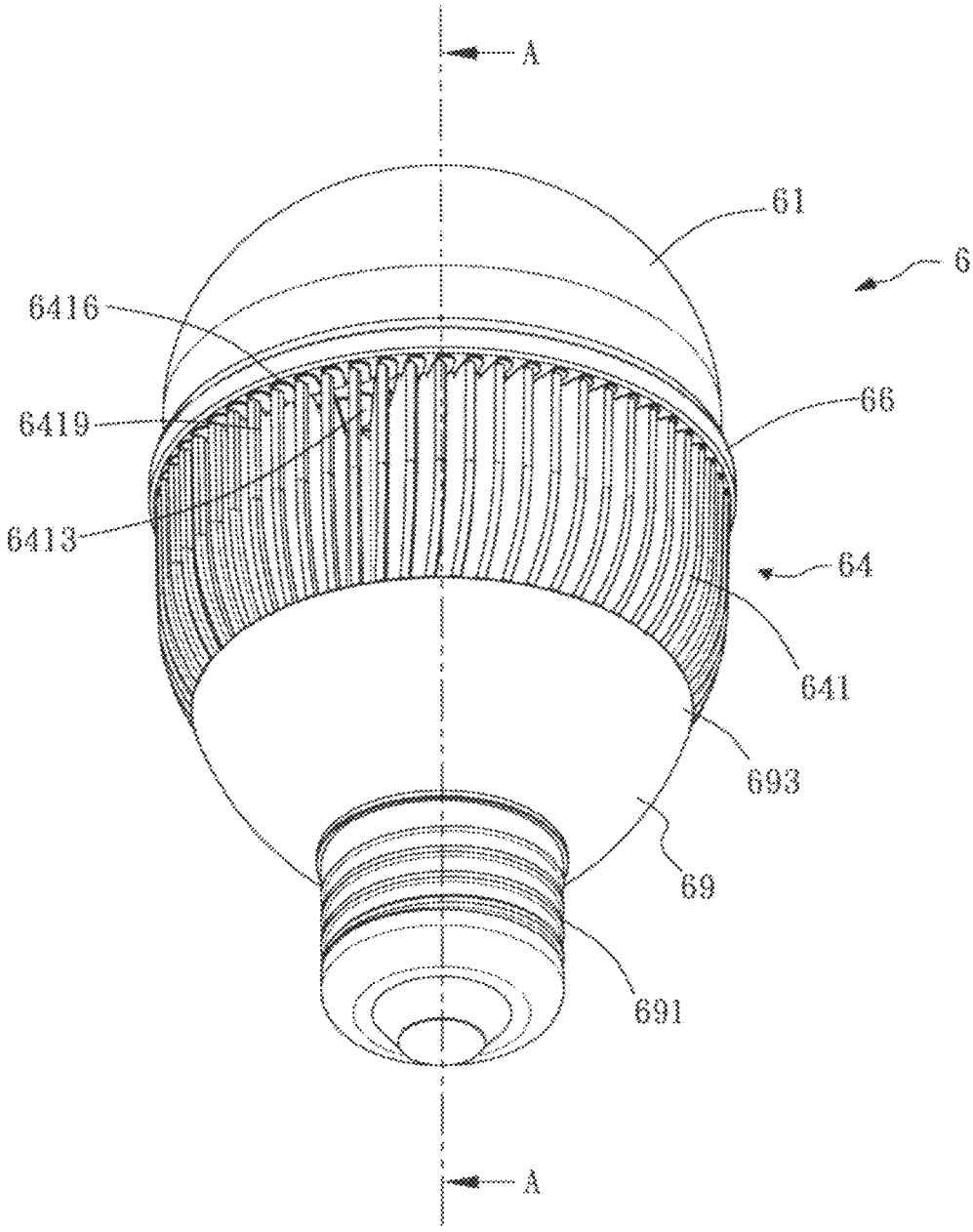
FIG. 3 is a perspective view of an LED lamp having a heat-dissipating module according to the present invention.
Figure 4:
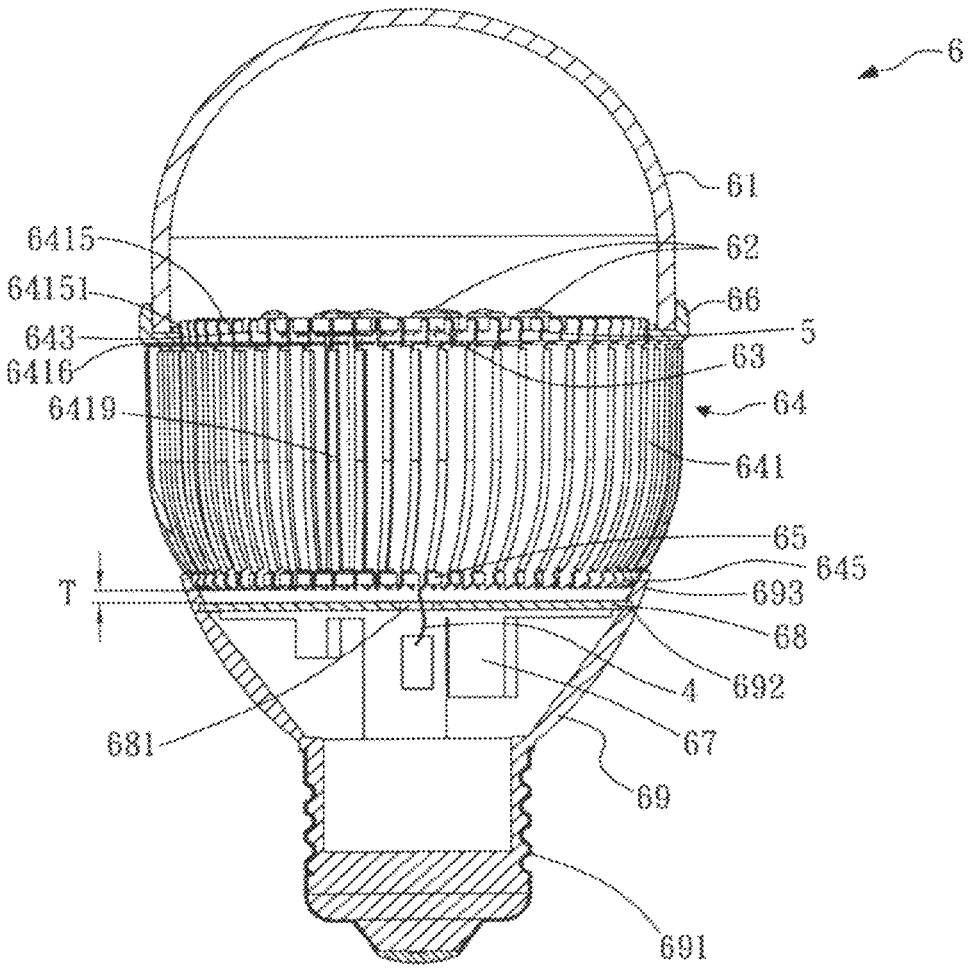
FIG. 4 is a cross-sectional view of an LED lamp having a heat-dissipating module taken along line A-A of FIG. 3 according to the present invention.

Referring to FIG. 2, FIG. 3 and FIG. 4, there are shown an exploded view, a perspective view, and a A-A cross-sectional view of an LED lamp 6 having a heat-dissipating module 64 according to the present invention, respectively. The LED lamp 6 having the heat-dissipating module 64 according to the present invention comprises a lampshade 61, at least an LED unit 62, a substrate 63, the heat-dissipating module 64, a fixing element 65, an annular protective cover 66, a circuit board 67, a thermally insulating panel 68, and a base 69.

The LED unit 62 is disposed on and coupled to the substrate 63. A plurality of passive components or simple circuits are disposed on the substrate 63 and connected to a power supply required for the LED unit 62 to emit light. Heat generated by the LED unit 62 (on the substrate 63) operating in a light-emitting mode is transferred to the heat-dissipating module 64 and dissipated to the surroundings. An insulating material (including, but not limited to, epoxy resin) may be applied to the substrate 63, so as to prevent a short circuit from occurring to the LED unit 62 or a simple circuit thereof. The substrate 63 is one of an aluminum substrate, a copper substrate, a ceramic substrate, a FR4 substrate, and a metal substrate. In this embodiment, the substrate 63 is formed by sintering a ceramic plate and is further configured to carry an integrated circuit (IC) essentially comprising a silver wiring. The heat-dissipating module 64 comprises a plurality of cooling fins 641 which are arranged radially, spaced apart from each other, and connected annularly. The heat-dissipating module 64 is coupled to the substrate 63. A hollow core 642 is formed centrally in the heat-dissipating module 64.

Referring to FIG. 5, FIG. 6, FIG. 7, and FIG. 8, there are shown a top view of the heat-dissipating module 64 of an LED lamp, a perspective view, a top view, and a front view of cooling fins of the heat-dissipating module according to the present invention. The heat-dissipating module 64 comprises a plurality of said cooling fins 641 which are made of metal, arranged radially, spaced apart from each other, and connected annularly. Each of the cooling fins 641 bends at a preset position thereof in a first direction (including, but not limited to, a direction perpendicular to the central axis of the heat-dissipating module 64). The cooling fins 641 of the heat-dissipating module 64 each further comprise a first flap 6411 and a second flap 6412. The first flap 6411 and the second flap 6412 together form a preset included angle θ therebetween. The included angle θ of the cooling fins 641 preferably ranges between 100° and 170°.

A first connecting portion 6413 and a second connecting portion 6414, which bend in the first direction, are disposed at preset positions on upper edges of the first flap 6411 and the second flap 6412 of the cooling fins 641, respectively. A step-like extending portion 6415 and a carrying portion 6416 bending in the first direction are disposed on the upper edge of the first flap 6411. An outward-facing hook 64151 is disposed at the top end of the extending portion 6415. A first lower step 643 is formed above the heat-dissipating module 64, defined by the extending portion 6415 relative to the first connecting portion 6413 and the second connecting portion 6414, and coupled to the substrate 63. A second lower step 644 with an inward profile is disposed at the lower edge of each of the cooling fins 641 and oriented in a direction opposite to the first lower step 643. A third connecting portion 6417 and a fourth connecting portion 6418 which correspond in position to the first connecting portion 6413 and the second connecting portion 6414, respectively, are disposed on the inner side of the second lower step 644 and bent inward.

With the cooling fins 641 each bending at the included angle θ, the first connecting portions 6413 and the second connecting portions 6414 together function as a bottom side of the first lower step 643, such that the substrate 63 and the LED unit 62 are mounted on the bottom side of the first lower step 643. Likewise, the third connecting portion 6417 and the fourth connecting portion 6418 together function as a bottom side of the second lower step 644. The fixing element 65 is mounted on the third connecting portion 6417 and the fourth connecting portion 6418. An opening 651, which is disposed centrally at the fixing element 65, communicates with the hollow core 642 and thereby provides a passage required for the electrical connection between the circuit board 67 and the substrate 63.

In this embodiment, the fixing element 65, which is a plate, is affixed to the bottom side of the second lower step 644 by means of a heat-resistant glue; in other words, the fixing element 65 is affixed to the third connecting portion 6417 and the fourth connecting portion 6418 and thereby configured to fix the cooling fins 641 in place. In another embodiment not shown, the fixing element 65 can also be a ring affixed to the hollow core 642 of the heat-dissipating module 64 by means of a heat-resistant glue and thereby configured to fix the cooling fins 641 in place. The fixing element 65 is made of one of a bakelite sheet, metal, and plastic.

The annular protective cover 66 is ring-shaped and is of an L-shaped cross-section. A cavity 661 is disposed centrally at the annular protective cover 66 to correspond in position to the first lower step 643. A bottom surface 662 of the annular protective cover 66 being of an L-shaped cross-section is further coupled to the carrying portion 6416 and engaged with the hook 64151 of the extending portion 6415; as a result, a periphery of each of the cooling fins 641 is encased and enclosed, such that the annular protective cover 66 is firmly coupled to the heat-dissipating module 64. In this embodiment, the annular protective cover 66 is made of heat-resistant acrylic resin, and the bottom surface 662 is glued to the carrying portion 6416 by means of an adhesive. The lampshade 61 is a transparent, translucent, frosted, or colored cover body. The lampshade 61 is coupled to the annular protective cover 66 being of an L-shaped cross-section and adapted to cover the substrate 63 from above, such that a light ray which is projected from the LED unit 62 penetrates the lampshade 61 and propagates to the outside, thereby bringing about the effect of light homogenizing, light scattering, or light concentrating.

Figure 9:
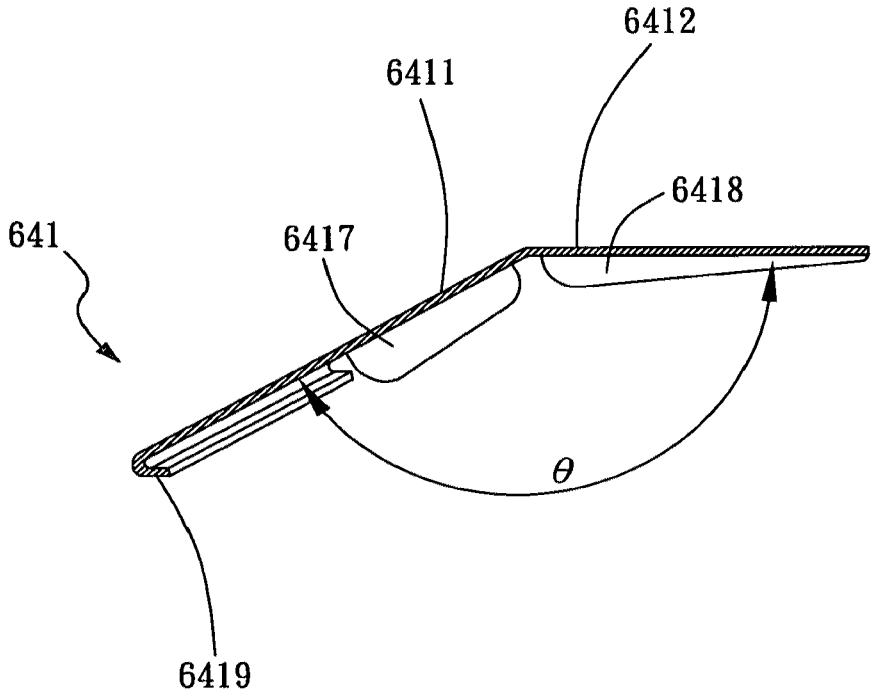
FIG. 9 is a cross-sectional view of cooling fins of a heat-dissipating module according to the present invention.

A peripheral margin of the cooling fins 641 doubles back from a preset position thereof and extends toward the first lower step 643 to form an elongate curved bend 6419. As shown in FIG. 9, the curved bend 6419 substantially reaches an appropriate point beneath the heat-dissipating module 64 to allow a convenient and safe user's grip thereon, reinforce the cooling fins 641, and increase the heat-dissipating area of the cooling fins 641 because not only the curved bend 6419 has a pleat 2 mm to 6 mm wide substantially but a pleated portion of the curved bend 6419 is attached to a surface of the first flap 6411 of the cooling fins 641. Hence, unlike the prior art that discloses pleating the margin of each of the cooling fins 641 by 180° and then pressing the pleated margins onto the cooling fins 641, respectively, but fails to increase the heat-dissipating surface area of the cooling fins 641, the present invention discloses the curved bend 6419 which is not attached to the surface of the cooling fin 641, so as to increase the heat-dissipating area and the heat-dissipating efficiency of the cooling fins 641. The cooling fins 641 of the heat-dissipating module 64 are made of a highly thermally conductive metal, such as iron, copper, aluminum, silver, nickel, or gold, or an alloy thereof.

The circuit board 67 comprises a circuit loop disposed inside the base 69. Also, with a wire 4, the circuit board 67 is electrically connected to the LED unit 62 coupled to the substrate 63 through a via 681 of the thermally insulating panel 68 and the hollow core 642.

As shown in FIG. 4, at least a said via 681 is disposed above the thermally insulating panel 68 and adapted to communicate with the hollow core 642 and the opening 651, so as to provide a passage required for the electrical connection between the circuit board 67 and the substrate 63. The thermally insulating panel 68 is inserted into a groove 692 disposed on an inner edge of the base 69 and positioned between the heat-dissipating module 23 and the circuit board 67. The thermally insulating panel 68 is spaced apart from the bottom of the heat-dissipating module 64 by a preset distance T for protecting the circuit board 67. Air present in a space sandwiched between the thermally insulating panel 68 and the bottom of the heat-dissipating module 64 and defined by the preset distance T therebetween serves to insulate the thermally insulating panel 68 and the heat-dissipating module 64 from each other. Furthermore, the air present in the space and ambient air exchange heat by convection, thereby enhancing heat dissipation. The thermally insulating panel 68 is made of an insulating non-metal with an extremely low thermal conductivity. Hence, for all the above reasons, the circuit board 67 disposed inside the base 69 can be better protected against the heat generated by the LED unit 62 in operation, so as to extend the service life of the circuit board 67 greatly and enhance the stability of the use of the LED lamp 6 having a heat-dissipating module. The preset distance T between the thermally insulating panel 68 and the heat-dissipating module 64 ranges between 2 mm and 6 mm. The thermally insulating panel 68 which is made of a non-metal good at thermal insulation includes, but is not limited to, a heat-resistant plastic plate, a ceramic plate, a glass plate, or a mica sheet.

The base 69 is a hollow casing for accommodating the circuit board 67 and the thermally insulating panel 68. The base 69 is coupled, by means of a fringe 693 thereof, to the engaging portion 645 beneath the heat-dissipating module 64. The base 69 is laterally provided with an electrically conductive thread 691 for electrical connection to the circuit board 67.

In a preferred embodiment of the present invention, the electrically conductive thread 691 of the base 69 are configured to comply with the specifications of metallic swivel adapters of common conventional incandescent lamps, namely E11, E12, E14, E17, E26, E27, and E40. The numeral behind the letter "E" denotes the diameter of the electrically conductive thread 691. For example, household lamps usually fall within the E27 category, and thus the thread diameter of the metallic swivel adapters for use with the lamps is 27 mm (i.e., 2.7 cm).

Furthermore, the LED lamp 6 having a heat-dissipating module according to the present invention meets a specification selected from the group consisting of MR-16, A-Bulb, AR111, PAR-20, PAR30, PAR38, GU-10, E11, and E17. The LED lamp 6 is applicable to a light-emitting carrier selected from the group consisting of ceiling light, bay light, desk light, streetlight, searchlight, projection light, hand-held lamp, light bulb, and down light.

A heat conduction medium 5 for increasing a heat transfer rate can be applied to engaging surfaces of the substrate 63, wherein the engaging surfaces of the substrate 63 enable the substrate 63 to engage with the first connecting portion 6413 and the second connecting portion 6414 of the cooling fins 641, respectively. The heat conduction medium 5 is one of a solder paste, a heat conductive grease, and a heat conductive glue. The effect of heat conduction and heat dissipation is optimal when the solder paste, rather than the heat conductive grease or the heat conductive glue, is used as the heat conduction medium 5 in soldering the substrate 63 to the first connecting portion 6413 and the second connecting portion 6414, so as to further enhance the heat-dissipating efficiency of a heat-dissipating module of the present invention.

Figure 5:
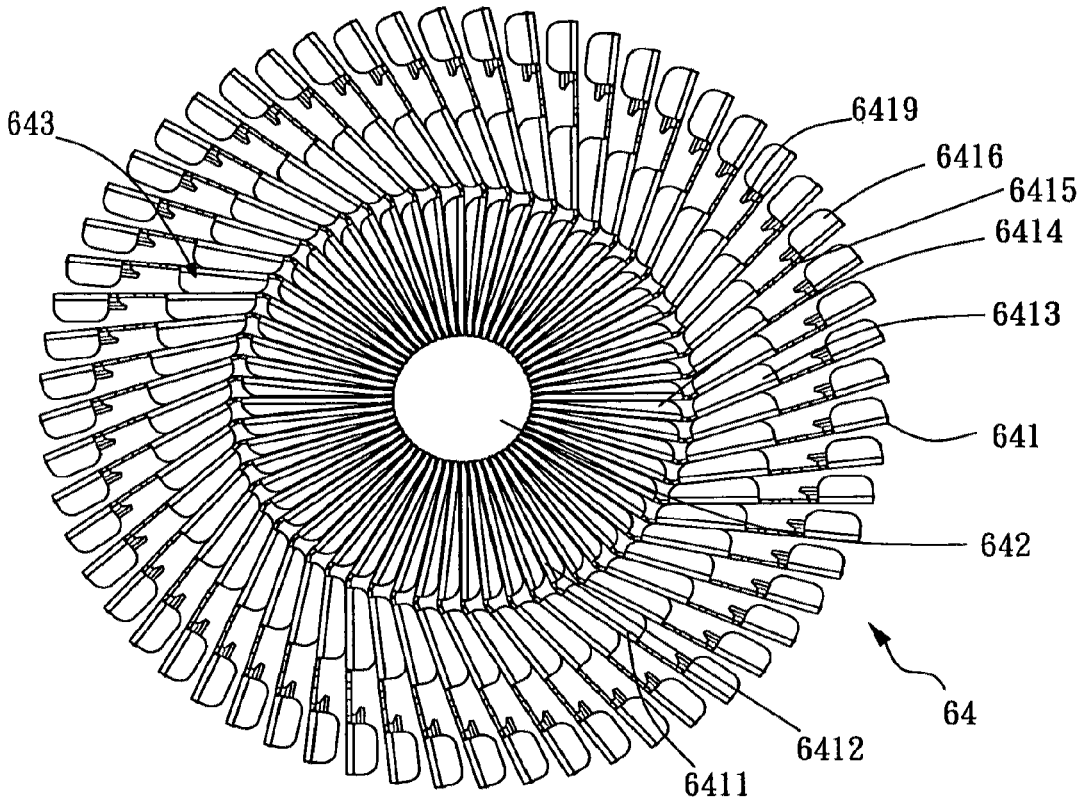
FIG. 5 is a top view of a heat-dissipating module according to the present invention.
Figure 6:
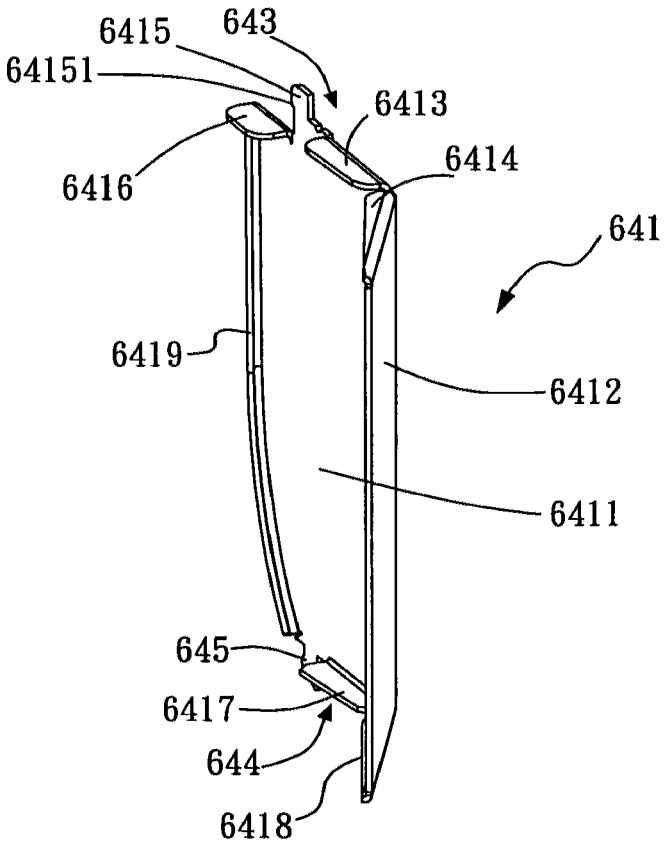
FIG. 6 is a perspective view of cooling fins of a heat-dissipating module according to the present invention.
Figure 7:
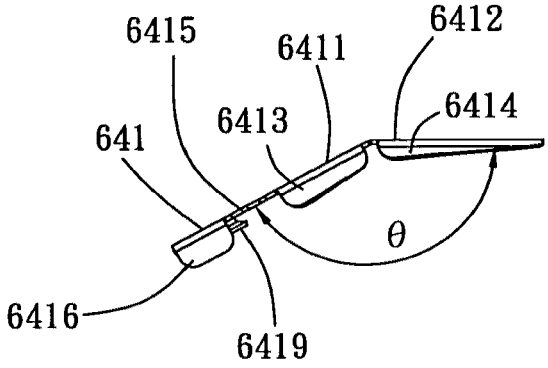
FIG. 7 is a top view of cooling fins of a heat-dissipating module according to the present invention.
Figure 8:
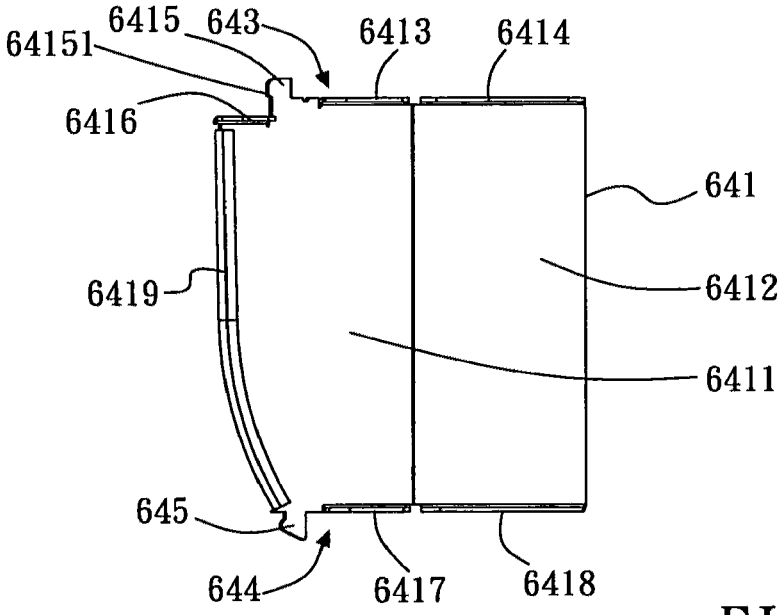
FIG. 8 is a front view of cooling fins of a heat-dissipating module according to the present invention.

From the perspective of the downward direction shown in FIG. 5 and FIG. 7, the cooling fins 641 each bend at a preset position and in the first direction, such that a preset included angle θ is formed between the first flap 6411 and the second flap 6412 of each of the cooling fins 641. Likewise, the cooling fins 641 are arranged radially, spaced apart from each other, and connected annularly in a manner to form the heat-dissipating module 64 in which the hollow core 642 is centrally formed. Accordingly, not only is it feasible to increase the surface area (i.e., the heat-dissipating area) of the cooling fins 641 on the premise that the outer diameter thereof is uniform, but the overall heat-dissipating efficiency of the heat-dissipating module 64 of the LED lamp 6 is enhanced.

The triangle inequality theorem states that, for any triangle, the sum of the lengths of any two sides must be greater than the length of the remaining side. Applying the theorem to the heat-dissipating module of the present invention and keeping uniform the outer diameter of the LED lamp 6 can bring about a dimensional feature of the cooling fins 641, that is, bending the cooling fins 641 increases the surface area thereof and thereby increases the heat-dissipating area of the heat-dissipating module 64 in its entirety. Hence, the cooling fins 641 thus bent can dissipate the heat generated by the LED unit 62 to the surroundings quickly through the cooling fins 641 of an enlarged surface area, so as to enhance the heat-dissipating efficiency of the LED lamp 6 while still meeting the requirement of a constant outer diameter (because commercially available indoor lamps usually have their respective standardized specifications regarding dimensions, such as an outer diameter), speed up the temperature dropping process of the LED lamp 6, and extend the service life of the LED lamp 6.

While the present invention has been particularly shown and described with reference to a preferred embodiment, it will be understood by those skilled in the art that various changes in form and detail may be without departing from the spirit and scope of the present invention.

What is claimed is:

1. A heat-dissipating module comprising a plurality of cooling fins arranged radially, spaced apart from each other, and connected annularly in a manner that a hollow core is formed centrally in the heat-dissipating module, characterized in that:

the cooling fins each bend at a preset position thereof and in a first direction, such that the cooling fins each further comprise a first flap and a second flap, wherein the first flap and the second flap have a preset included angle therebetween; and wherein a first connecting portion and a second connecting portion, which bend in the first direction, are disposed at preset positions on upper edges of the first flap and the second flap of the cooling fins, respectively, wherein a step-like extending portion and a carrying portion bending in the first direction are disposed on the upper edges of the first flap, an outward-facing hook is disposed at a top end of the extending portion, wherein a first lower step is formed above the heat-dissipating module and defined by the extending portion relative to the first connecting portion and the second connecting portion, wherein a second lower step with an inward profile is disposed at the lower edge of each of the cooling fins and oriented in a direction opposite to the first lower step, wherein a third connecting portion and a fourth connecting portion corresponding in position to the first connecting portion and the second connecting portion, respectively, are disposed on an inner side of the second lower step and bent inward.

2. The heat-dissipating module of claim 1, wherein the included angle of the cooling fins ranges between 100° and 170°.

3. The heat-dissipating module of claim 1, wherein a peripheral margin of the first flap of each of the cooling fins doubles back from a preset position thereof and extends toward the first lower step to form an elongate curved bend, such that the curved bend has a pleat 2 mm to 6 mm wide substantially, and a pleated portion of the curved bend is not attached to a surface of the first flap.

4. An LED lamp having a heat-dissipating module, comprising:

a substrate with at least an LED unit thereon;

a heat-dissipating module comprising a plurality of cooling fins arranged radially, spaced apart from each other, and connected annularly in a manner that the substrate is coupled to the heat-dissipating module and a hollow core is formed centrally in the heat-dissipating module;

a base provided in form of a hollow casing and coupled to the heat-dissipating module from beneath; and a circuit board comprising a circuit loop, wherein the circuit board is received in the base and electrically connected to the at least an LED unit coupled to the substrate through the hollow core;

wherein the cooling fins each bend at a preset position thereof and in a first direction, such that the cooling fins each further comprise a first flap and a second flap, wherein the first flap and the second flap have a preset included angle therebetween; and wherein a first connecting portion and a second connecting portion, which bend in the first direction, are disposed at preset positions on upper edges of the first flap and the second flap of the cooling fins, respectively, wherein a step-like extending portion and a carrying portion bending in the first direction are disposed on the upper edges of the first flap, an outward-facing hook is disposed at a top end of the extending portion, wherein a first lower step is formed above the heat-dissipating module and defined by the extending portion relative to the first connecting portion and the second connecting portion, wherein a second lower step with an inward profile is disposed at the lower edge of each of the cooling fins and oriented in a direction opposite to the first lower step, wherein a third connecting portion and a fourth connecting portion corresponding in position to the first connecting portion and the second connecting portion, respectively, are disposed on an inner side of the second lower step and bent inward.

5. The LED lamp of claim 4, wherein the included angle of the cooling fins ranges between 100° and 170°.

6. The LED lamp of claim 4, further comprising a thermally insulating panel inserted into the base and positioned between the heat-dissipating module and the circuit board, wherein the thermally insulating panel has a via and is spaced apart from the heat-dissipating module by a preset distance ranging between 2 mm and 6 mm.

7. The LED lamp of claim 4, further comprising a fixing element, an annular protective cover, and a lampshade, characterized in that:

the base is coupled to an engaging portion beneath the heat-dissipating module;

the fixing element is disposed above a third connecting portion and a fourth connecting portion, positioned inside the second lower step, and centrally provided with an opening in communication with the hollow core, the substrate being disposed above the first lower step;

the annular protective cover is engaged with the hook of the extending portion, coupled to the carrying portion, and configured to encase and enclose a periphery of the cooling fins;

the lampshade is coupled to the annular protective cover and adapted to cover the substrate from above; and a peripheral margin of the cooling fins doubles back from a preset position thereof and extends toward the first lower step to form an elongate curved bend.

8. The LED lamp of claim 7, characterized in that:

the substrate is soldered to the first connecting portion and the second connecting portion through engaging surfaces of the substrate and by means of a solder paste;

the fixing element is affixed to the third connecting portion and the fourth connecting portion through engaging surfaces of the fixing element and by means of a heat-resistant glue;

the curved bend has a pleat 2 mm to 6 mm wide substantially, and a pleated portion of the curved bend is not attached to a surface of the first flap;

the substrate is one of a ceramic substrate, a FR4 substrate, and a metal substrate; and the fixing element is made of one of a bakelite sheet, metal, and plastic.

* * * * *